United States Patent [19]

Grunder et al.

[11] 4,023,472

[45] May 17, 1977

[54] APPARATUS FOR PRODUCING A LAMINAR FLOW

[75] Inventors: Hans Grunder, Rheinfelden; Walter Setz, Gipf-Oberfrick, both of Switzerland

[73] Assignee: Ciba-Geigy Corporation, Ardsley, N.Y.

[22] Filed: May 27, 1975

[21] Appl. No.: 581,076

Related U.S. Application Data

[63] Continuation-in-part of Ser. No. 476,171, June 4, 1974, abandoned.

[52] U.S. Cl. ..... 98/40 D; 55/385 A; 55/467; 55/482; 55/DIG. 29; 55/416

[51] Int. Cl.[2] ..... F24F 13/06

[58] Field of Search ..... 55/385 A, 471, 473, 55/467, 416, 482, 495, 525, DIG. 29; 98/36, 40 C, 40 D

[56] References Cited

UNITED STATES PATENTS

| | | | |
|---|---|---|---|
| 1,708,065 | 4/1929 | Jordahl et al. | 55/483 X |
| 2,146,071 | 2/1939 | Horvath | 55/473 X |
| 2,271,662 | 2/1942 | Rubissow | 55/525 X |
| 2,500,606 | 3/1950 | Dosmar | 98/36 |
| 2,952,342 | 9/1960 | Schnittker | 55/482 X |
| 3,090,180 | 5/1963 | Berz et al. | 55/350 X |
| 3,279,883 | 10/1966 | Thompson et al. | 55/DIG. 29 X |
| 3,280,542 | 10/1966 | Heijnis | 55/525 X |
| 3,518,814 | 7/1970 | Maynard | 55/473 X |
| 3,724,172 | 4/1973 | Wood | 55/DIG. 29 X |
| 3,726,204 | 4/1973 | Lindeström | 98/36 |
| 3,817,160 | 6/1974 | Searcy et al. | 98/36 |
| 3,820,536 | 6/1974 | Anspach, Jr. et al. | 55/DIG. 29 X |
| 3,893,457 | 7/1975 | Van der Waaij | 98/36 X |

FOREIGN PATENTS OR APPLICATIONS

| | | | |
|---|---|---|---|
| 4,968 | 11/1905 | France | 55/484 |
| 713,624 | 8/1954 | United Kingdom | 55/525 |
| 747,144 | 3/1956 | United Kingdom | 55/487 |
| 833,852 | 5/1960 | United Kingdom | 55/487 |

*Primary Examiner*—Frank W. Lutter
*Assistant Examiner*—Kathleen J. Prunner
*Attorney, Agent, or Firm*—Harry Falber

[57] ABSTRACT

A laminar flow producing means is described having a blower which passes air to a distributor having a buffer zone with a ratio between its volume and cross-sectional area A being smaller than ½ $\sqrt{A}$ and two mesh screens spaced about 0.2 to 5 cm apart and each having mesh openings measuring about 0.001 to 1mm so that the air from the blower is passed through the screen meshes seriatim to produce a clean, dust-free laminar flow of air.

10 Claims, 3 Drawing Figures

1
2
2
3
3
4
4
6
6
10
11
12
31
31
32
32
32
33
33
34
34
35
35
36
36
36
II
II

APPARATUS FOR PRODUCING A LAMINAR FLOW

CROSS-REFERENCES TO RELATED APPLICATIONS

This application is a continuation-in-part of application Ser. No. 476,171, filed June 4, 1974 and now abandoned.

FIELD OF THE INVENTION

This invention relates to means for producing laminar flow.

In the dust-free room art the laminar flow system is becoming increasingly important. This is a system for ventilating a workplace or an entire room. The main aims of the laminar flow system are minimum dust eddying and very rapid removal of any dust or other suspensions which may be present. The inflowing air must therefore be of very low turbulence and have very reduced particle contents. in strictly physical terms, the laminar flow system is not really a laminar flow, but represents a displacement flow substantially free from turbulence.

PRIOR ART

The usual way of producing laminar flows is to force air through appropriate filters. Depending upon the particular use for which they are required, the filters can also be devised to retain, in addition to the ordinary suspended solids such as dust particles and so on, micro-organisms to a required extent. A cleaned air flow of this kind is advantageous wherever processes have to be carried out free from environmental contamination.

Conventionally, and depending upon the particular work to be performed, either the complete working area or just closed-off portions thereof have had laminar flow ventilation. In both cases the filters needed have to have a large superficial area and are therefore costly. It has been found that with this conventional method of ventilation the laminar flow has often also been operative on such items of equipment within the room or compartment that do not require this particular kind of ventilation. The zone which really has to be kept 100% clean is often relatively small, in which event it has superfluous and costly to provide expensive laminar flow ventilation of an entire room or compartment or chamber.

Theoretically, of course, the filters needed to produce a laminar flow can be adapted to the dimensions of the zones to be kept clean, but in practice this state of affairs cannot be achieved for economic reasons, more particularly because commercial filters are available only in specific standards sizes and one-of items would cost far too much.

Perforated plates can of course be used to produce a laminar flow; unfortunately, it has been found that the number of perforations per unit of area, perforation cross-section and longitudinal section and the speed of the air passing through the perforations are intimately connected by complicated conditions which make the production of perforated plates difficult, heavy technical expenditure being needed such that the plates are very costly and their use can be considered only for special purposes.

As illustrative of the prior art, reference is made to the chapter entitled "Test Code for Air Moving Devices" in the AMCA Standard 210–67 (FIG. 4.4) which discloses a test apparatus for ventilators. The measuring chamber of this apparatus is provided with a steadying means which consists of two mesh screens and perforated plate positioned upstream in front of them. According to this AMCA Standard, it is required that the spacing between the perforated plate and the air inlet to the measuring chamber be greater than half the diameter of the chamber. Referred to the cross-sectional area of the chamber and the volume of the zone in front of the perforated plate, this condition means that the ratio between volume and cross-sectional area must be greater than $\sqrt{A/\pi}$, wherein $A$ denotes the cross-sectional area. On the basis of this condition, the man skilled in the art will assume that an adequate steadying effect and much less a laminar flow are not attainable with a steadying means made from a perforated plate and mesh screens unless there is a buffer zone of sufficient depth provided in front of the steadying means. Applied to air distributors, this would mean, however, that mesh screens absolutely postulate a deep buffer zone or alternatively that a steadying means consisting of mesh screens is unsuitable for shallower air distributors with a less deep buffer zone. In other words, the features, mesh screens on the one hand and shallow buffer zone on the other, appear to be mutually exclusive.

SUMMARY OF THE INVENTION

The invention relates to an apparatus for producing a laminar flow, the apparatus comprising a blower; at least one air distributor which is connected to a blower via a conduit; a buffer zone and a steadying means in the air distributor; a ratio between volume and cross-sectional area of the buffer zone smaller than ½ $\sqrt{A}$; a plurality of mesh screens which are spaced apart and parallel to each other and which form the steadying means, the air flow through these screens proceeding in seriatim; mesh openings measuring about 0.001 to 1 mm; and spacing between the mesh screens of about 0.2 to 5 cm.

The subject invention thus does not relate to conventional laminar flow apparatus, but to one whose air distributors, measured vertically to the plane of the steadying means, are shallow in construction. The requirement of shallow construction of the air distributors is an important feature because in most applications, e.g. the laminar ventilation of zones of manufacturing plants, filling stations or the like, only very limited space is available and this does not permit, or at least it greatly complicates, the use of air distributors of larger dimensions.

In other words, the present invention is based on the novel and entirely surprising finding that a deep buffer zone is not required for the production of laminar flow of air in a steadying means consisting solely of mesh screens. As can be proved by measurements, the reduction of the depth of the buffer zone is up to less than 30% of the value indicated by the expression ½ $\sqrt{A}$ without any detrimental influence on the efficiency of a steadying means consisting of mesh screens. The subject invention, therefore, shows that mesh screens are highly suitable as steadying means for shallow air distributors.

The novel shallow air distributor according to the present invention can be manufactured very simply in any desired cross-sectional form and consequently can be optimally adapted to each special utility, thereby providing great flexibility. Also, its first costs are much lower than those of filters or perforated plates.

BRIEF DESCRIPTION OF DRAWINGS

The invention will be described in greater detail hereinafter with reference to an embodiment shown in the drawings wherein.

DETAILED DESCRIPTION OF PREFERRED EMBODIMENT

Figure 1:
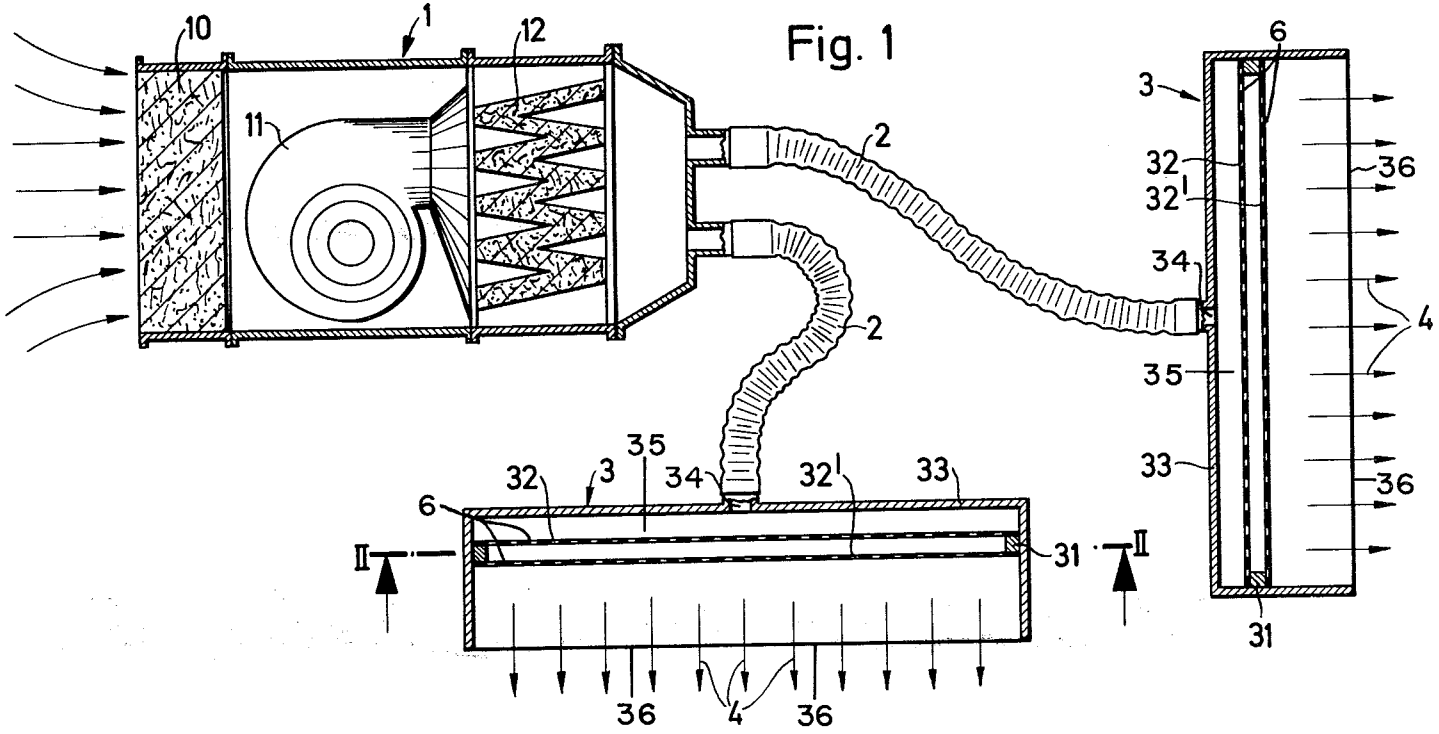
FIG. 1 is a section through apparatus according to the invention.

The apparatus shown in FIG. 1 for producing a laminar flow comprises an air preparation unit 1 and, connected thereto via flexible lines 2, two air distributors 3. Unit 1 comprises a coarse or first filter 10, a blower 11 and a microfilter 12. If necessary a heating or cooling register can also be provided. Air which has been cleaned and filtered in the unit 1 flows turbulently through hoses 2 to the two distributors 3. The invention is not of course limited to two air distributors; a number of air distributors or just a single one can be provided.

Figure 2:
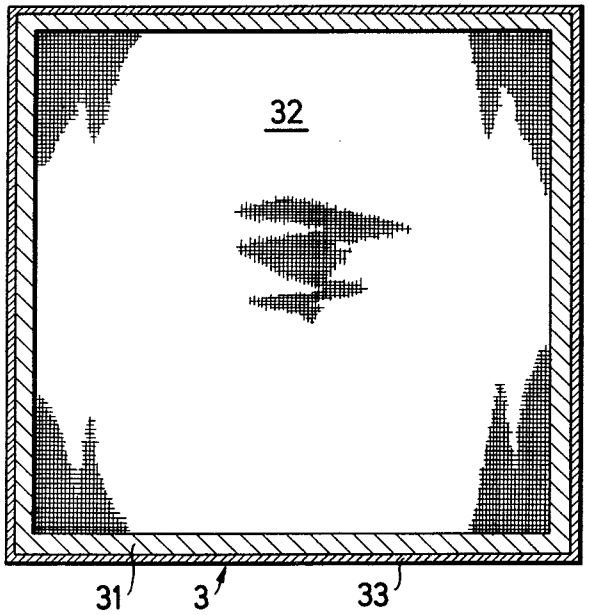
FIG. 2 is a section on the line II—II of FIG. 1.

Each distributor 3 mainly comprises a frame 31 on which a plurality, and preferably two filter mesh screens 32, 32′ are stretched. As can be seen in FIG. 2, the frame shape is adapted to the particular zone to be ventilated. The members 32, 32′ take the form of a fine-mesh or textile fabric.

The arrangement of the mesh screens 32, 32′ is referred to as the "steadying means"6 which serves to reduce air turbulence. The screens 32, 32′ are positioned in parallel, spaced apart configuration such that the incoming air flow contacts and passes through the mesh surface of screens 32, 32′. Furthermore, since the frame 31 abuts all sides of distributor 3, the air flow must proceed through screens 32, 32′.

Preferably, the distance between two consecutive mesh screens is from 0.2 to approximately 5 cm. A distance of approximately 2 cm has been found especially satisfactory. Furthermore, the mesh openings of the individual screens are in a range of from about 0.005 to 1.0 mm with very good results being achieved with intermediate values of from about 0.01 to 0.1 mm., and preferably 0.08 to 0.1 mm. The two filters may or may not have the same mesh openings.

The shallow construction of air distributor 3, which is essential in ventilation applications wherein only limited space is available, is made possible by buffer zone 35. Although buffer zone 35 is of limited depth it nevertheless is sufficient to maintain the laminar flow of the air passing therethrough. Buffer zone 35 is positioned upstream of steadying means 6 and is defined by that portion of the distributor 3 between the first mesh screen 32 encountered by the air flow and the air inlet means of distributor 3. The ratio of volume and cross-sectional area of the buffer zone 35 constitutes the most suitable criterion for determining the shallowness or the depth (straight line distance the air flow traverses) of the air distributor 3. For purposes of this invention, this ratio is determined to be smaller than $\frac{1}{2}\sqrt{A}$, and preferably smaller than $1/6\sqrt{A}$, wherein $A$ denotes said cross-sectional area. Typical ratios include $1/30\sqrt{A}$ to $1/10\sqrt{A}$.

Frame 31 with its filter meshes 32, 32′ is secured in a casing 33 having an inlet means 34 to which the hose 2 is connected. The intaken air goes through hose 2 into casing 33, then traverses buffer zone 35, flows through the two filter meshes 32, 32′, which are disposed one after another so as to intercept the direction of the air flow and leaves the distributor via outlet means 36 as a laminar flow indicated by parallel arrows 4.

The novel air distributor of this invention thus facilitates the economical production, in limited areas of space, of laminar flows appropriate for dust-free environments.

Figure 3:
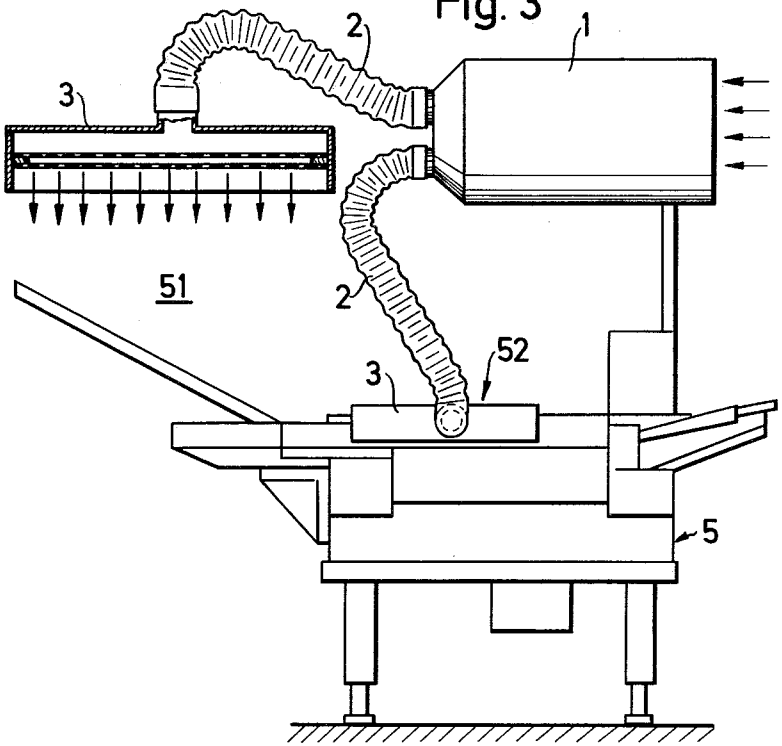
FIG. 3 shows the apparatus of FIG. 1 used in association with an ampoule-filling machine.

As an example of how the apparatus according to the invention can be used, FIG. 3 shows an ampoule-filling machine 5 utilized in conjunction with the apparatus shown in FIG. 1. The novel design of the apparatus according to the invention makes it possible to provide laminar-flow 100% cleanliness only of the zones which must be 100% clean, i.e. the entry zone 51 and the filling and closing zone 52 of machine 5; the ventilation of the other parts of machine 5 can be non-laminar. The area of the laminar-flow-ventilated zone of the machine can therefore be reduced by more than 60% as compared with the area which has to be laminar-flow-ventilated with the conventional filter method to ensure uncontaminated ventilation. In the case shown in FIG. 3, the filter meshes are two nylon cloths which are at a 2 cm. spacing from one another and which have a mesh opening of approximately 0.01 mm.

The air distributors are not limited to two filter meshes, a number of filter meshes can readily be provided in consecutive relationship if necessary. The mesh openings of the discrete filters may or may not be the same as one another, depending upon individual circumstances. The best combination of filter number and mesh openings is usually determined empirically, the use of two similar filter meshes usually being adequate for most purposes.

The air distributors need not necessarily be disposed separately from the air preparation unit; they can, for instance, be combined therewith to form one compact unit, as a means of providing small mobile laminar flow facilities at relatively low cost.

What is claimed is:

1. An apparatus for producing a displacement flow substantially free from turbulence, comprising a blower having an exhaust; at least one air distributor comprising an open frame-like housing which is provided with an inlet and with an open side which constitutes an outlet; conduit means connecting the exhaust of said blower to the inlet of said air distributor; a steadying means positioned within said housing between the inlet and the outlet and extending across the outlet so that air traveling from the inlet to the outlet passes through said steadying means, the steadying means comprising at least two parallel, spaced apart mesh screens extending across the outlet and having mesh openings of from about 0.005 to 1.0 mm with the spacing between any two adjacent mesh screens being from about 0.2 to 5 cm; and a buffer zone within said housing upstream of said steadying means and defined by that portion of the housing between the first mesh screen encountered by the air flow and said inlet, the ratio between the volume of the buffer zone and its cross-sectional area parallel to the outlet being smaller than $\frac{1}{2}\sqrt{A}$, wherein $A$ denotes said cross-sectional area.

2. The apparatus of claim 1, wherein the steadying means consists solely of said mesh screens.

3. The apparatus of claim 1, wherein the ratio between volume and cross-sectional area of the buffer zone is smaller than 1/6 $\sqrt{A}$.

4. The apparatus of claim 1, wherein the mesh openings are from about 0.08 to 0.1 mm.

5. The apparatus of claim 1, wherein the mesh openings of each of the screens comprising said steadying means are substantially identical.

6. An air distributor for producing a displacement flow substantially free from turbulence, comprising a frame-like housing with an air inlet and an air outlet constituted by an open side of the housing; a steadying means positioned within said housing between the inlet and the outlet and extending across the outlet so that air travelling from the inlet to the outlet passes through said steadying means, the steadying means comprising at least two parallel, spaced apart mesh screens extending across the outlet and having mesh openings of from about 0.005 to 1.0 mm with the spacing between any two adjacent mesh screens being from about 0.2 to 5 cm; and a buffer zone within said housing upstream of said steadying means and defined by that portion of the housing between the first mesh screen encountered by the air flow and said inlet, the ratio between the volume of the buffer zone and its cross-sectional area parallel to the outlet being smaller than ½ $\sqrt{A}$, wherein $A$ denotes said cross-sectional area.

7. The air distributor of claim 6, wherein the steadying means consists solely of said mesh screens.

8. The air distributor of claim 6, wherein the ratio between volume and cross-sectional area of the buffer zone is smaller than 1/6 $\sqrt{A}$.

9. The air distributor of claim 6, wherein the mesh openings are from about 0.08 to 0.1 mm.

10. The air distributor of claim 6, wherein the mesh openings of each of the screens comprising said steadying means are substantially identical.

* * * * *